US009684266B1

(12) United States Patent
Kuge et al.

(10) Patent No.: US 9,684,266 B1
(45) Date of Patent: Jun. 20, 2017

(54) DEVELOPER TRANSPORT DEVICE AND IMAGE FORMING APPARATUS

(71) Applicant: FUJI XEROX CO., LTD., Tokyo (JP)

(72) Inventors: Hideki Kuge, Kanagawa (JP); Atsushi Funada, Kanagawa (JP); Kiyohito Horii, Kanagawa (JP); Makoto Kanno, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/224,907

(22) Filed: Aug. 1, 2016

(30) Foreign Application Priority Data

Mar. 29, 2016 (JP) ..... 2016-065089

(51) Int. Cl.
*G03G 15/08* (2006.01)

(52) U.S. Cl.
CPC ..... *G03G 15/0891* (2013.01)

(58) Field of Classification Search
CPC combination set(s) only.
See application file for complete search history.

(56) References Cited

U.S. PATENT DOCUMENTS

2012/0251167 A1 10/2012 Matsumoto

FOREIGN PATENT DOCUMENTS

| | | | |
|---|---|---|---|
| JP | 2010-117658 | A | 5/2010 |
| JP | 2012-203386 | A | 10/2012 |
| JP | 2013-057849 | A | 3/2013 |

*Primary Examiner* — Clayton E Laballe
*Assistant Examiner* — Jas Sanghera
(74) *Attorney, Agent, or Firm* — Sughrue Mion, PLLC

(57) ABSTRACT

A developer transport device includes a cylinder member including first and second cylinders in which a transport path, through which a developer is transported, is formed, a transport member disposed in the transport path so as to transport the developer by rotating, a to-be-fastened member that is formed on one of the first and second cylinders and that has a first surface formed in a downstream end portion thereof in a direction in which the second cylinder is fastened to the first cylinder and a second surface extending in the direction, and a fastening member that is formed on another one of the first and second cylinders and is to be fastened to the to-be-fastened member, the fastening member having first and a second fastening surfaces that respectively face the first and second surfaces when the fastening member is fastened to the to-be-fastened member.

6 Claims, 9 Drawing Sheets

DEVELOPER TRANSPORT DEVICE AND IMAGE FORMING APPARATUS

CROSS-REFERENCE TO RELATED APPLICATIONS

This application is based on and claims priority under 35 USC 119 from Japanese Patent Application No. 2016-065089 filed Mar. 29, 2016.

BACKGROUND

Technical Field

The present invention relates to a developer transport device and an image forming apparatus.

SUMMARY

According to an aspect of the invention, there is provided a developer transport device including a cylinder member in which a transport path, through which a developer is to be transported, is formed, the cylinder member including a first cylinder member in which an upstream portion of the transport path is formed and a second cylinder member that is connected to the first cylinder member and in which a downstream portion of the transport path is formed, a transport member that is disposed in the transport path and that transports the developer by rotating, a to-be-fastened member that is formed on one of the first cylinder member and the second cylinder member, the to-be-fastened member having a first surface formed in a downstream end portion of the to-be-fastened member in a fastening direction in which the second cylinder member is fastened to the first cylinder member and a second surface formed in such a manner as to extend in the fastening direction, and a fastening member that is formed on another one of the first cylinder member and the second cylinder member and that is to be fastened to the to-be-fastened member, the fastening member having a first fastening surface and a second fastening surface that respectively face the first surface and the second surface when the fastening member is fastened to the to-be-fastened member.

BRIEF DESCRIPTION OF THE DRAWINGS

Exemplary embodiments of the present invention will be described in detail based on the following figures, wherein.

DETAILED DESCRIPTION

Figure 1:
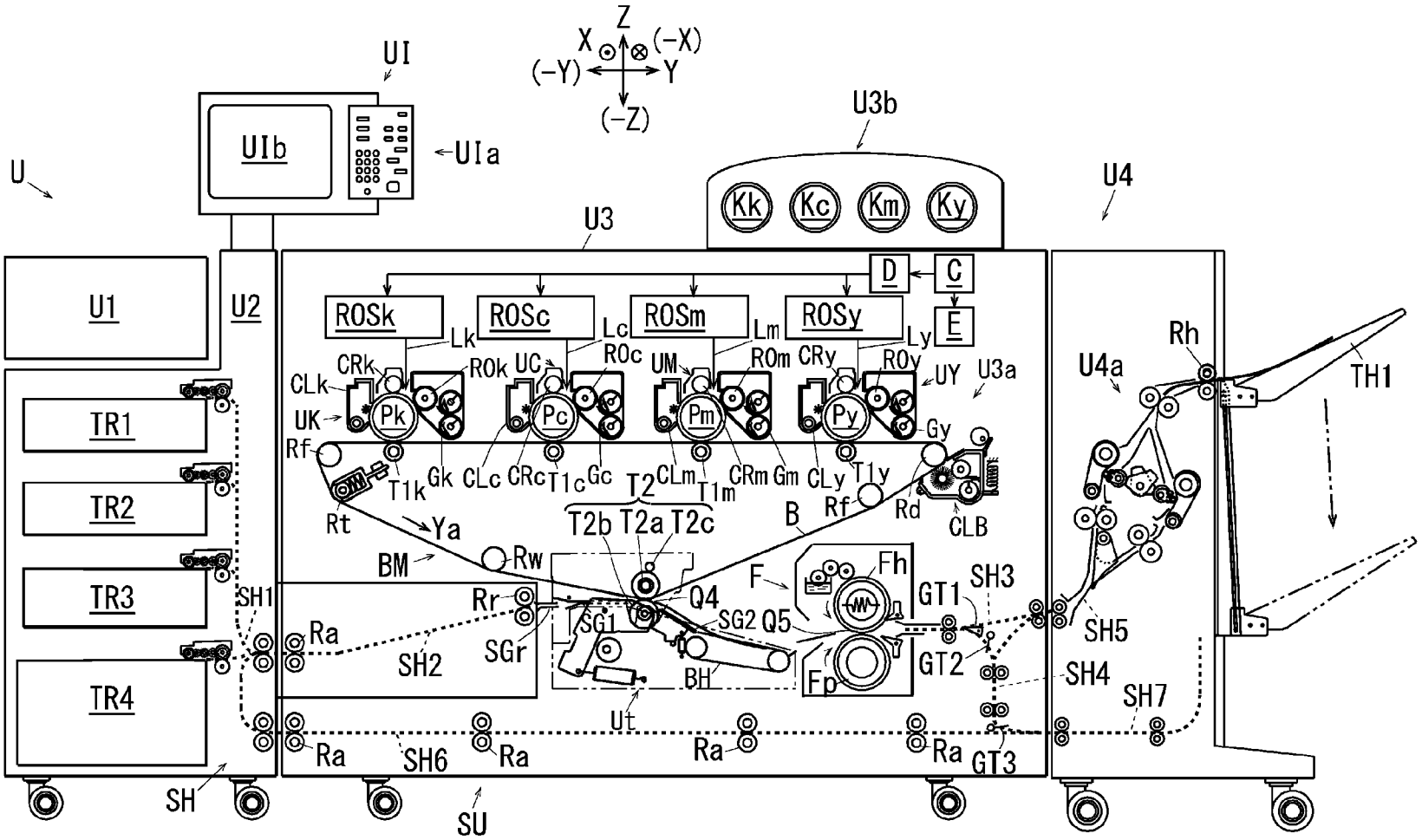
FIG. 1 is an overall view of an image forming apparatus according to an exemplary embodiment of the present invention.

Although an exemplary embodiment of the present invention will now be described as a specific example with reference to the drawings, the present invention is not limited to the following exemplary embodiment.

Note that, for ease of understanding of the following description, in the drawings, a front-rear direction, a left-right direction, and a top-bottom direction are respectively defined as the X-axis direction, the Y-axis direction, and the Z-axis direction, and directions or sides indicated by arrows X, −X, Y, −Y, Z, and −Z are respectively defined as a forward direction, a backward direction, a right direction, a left direction, an upward direction, and a downward direction or the front side, the rear side, the right side, the left side, the top side, and the bottom side.

In addition, a symbol having "•" in "○" denotes an arrow extending from the rear side to the front side as viewed in the drawings, and a symbol having "x" in "○" denotes an arrow extending from the front side to the rear side as viewed in the drawings.

Note that, in the following description, which refers to the drawings, descriptions of components that are not necessarily illustrated are suitably omitted for ease of understanding of the following description.

FIG. 1 is an overall view of an image forming apparatus according to an exemplary embodiment of the present invention.

Figure 2:
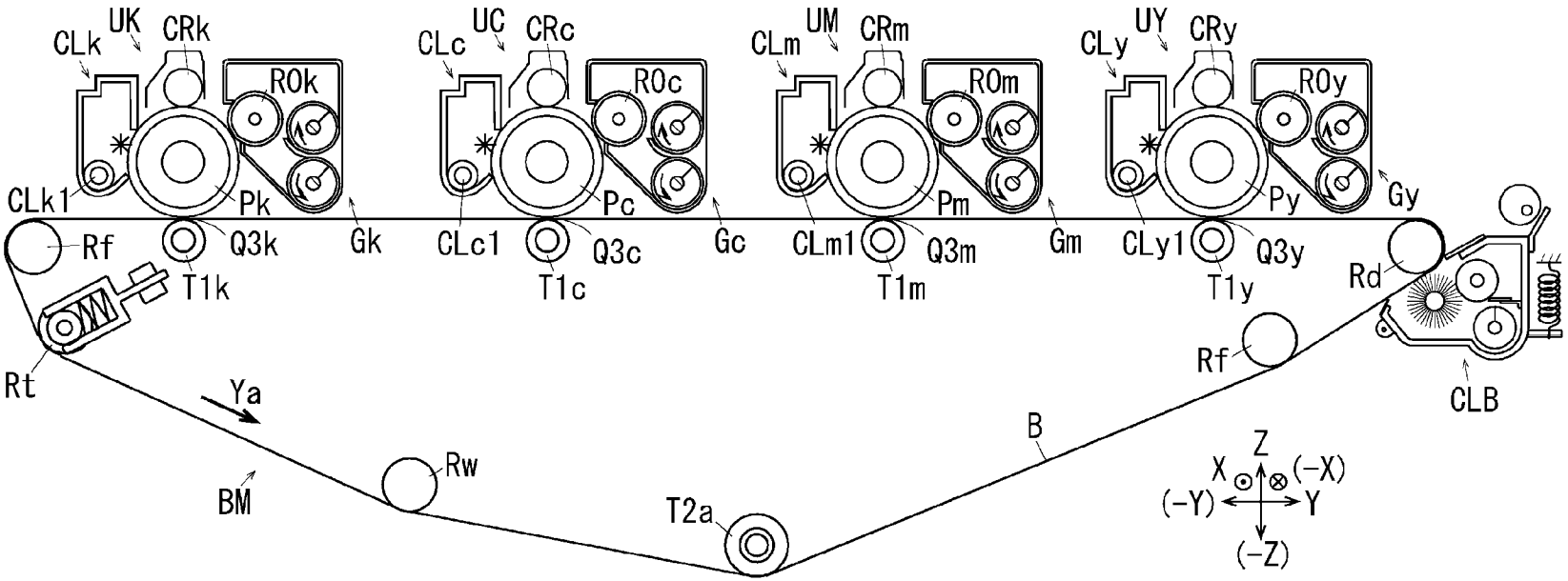
FIG. 2 is an enlarged view of a visible-image forming device according to the exemplary embodiment.

FIG. 2 is an enlarged view of a visible-image forming device according to the exemplary embodiment.

In FIG. 1, a copying machine U, which is an example of an image forming apparatus, includes an operation unit UI, a scanner U1, which is an example of an image reading device, a feeder unit U2, which is an example of a media-supply device, an image forming unit U3, which is an example of an image recording apparatus, and a media-processing device U4.

(Description of Operation Unit UI)

The operation unit UI includes input buttons UIa that are used for starting a copying operation, for setting the number of sheets to be copied, and the like. The operation unit UI further includes a display UIb that displays contents that are input by using the input buttons UIa and the state of the copying machine U.

(Description of Feeder Unit U2)

In FIG. 1, the feeder unit U2 includes plural sheet-feeding trays TR1, TR2, TR3, and TR4, each of which is an example of a media container. The feeder unit U2 further includes a media supply path SH1 and the like that take out recording sheets S, each of which is an example of an image recording medium and each of which is accommodated in one of the sheet-feeding trays TR1 to TR4, and transport the recording sheets S to the image forming unit U3.

(Description of Image Forming Unit U3 and Media-Processing Device U4)

In FIG. 1, the image forming unit U3 includes an image recording unit U3*a* that performs, on the basis of a document image read by the scanner U1, an image recording operation on one of the recording sheets S that has been transported from the feeder unit U2.

In FIG. 1 and FIG. 2, a driving circuit D of latent-image forming devices ROSy, ROSm, ROSc, and ROSk of the image forming unit U3 outputs, on the basis of image information input from the scanner U1, a driving signal that corresponds to the image information to the latent-image forming devices ROSy, ROSm, ROSc, and ROSk, each of which corresponds to one of colors of yellow (Y), magenta (M), cyan (C), and black (K), at a predetermined timing. Photoconductor drums Py, Pm, Pc, and Pk, each of which is an example of an image carrier, are disposed below the latent-image forming devices ROSy to ROSk.

Surfaces of the photoconductor drums Py, Pm, Pc, and Pk, which rotate, are uniformly charged by corresponding charging rollers CRy, CRm, CRc, and CRk, each of which is an example of a charger. Electrostatic latent images are formed on the charged surfaces of the photoconductor drums Py to Pk by laser beams Ly, Lm, Lc, and Lk that are respectively output by the latent-image forming devices ROSy, ROSm, ROSc, and ROSk. Each of the laser beams Ly, Lm, Lc, and Lk is an example of a latent-image writing light beam. The electrostatic latent images on the surfaces of the photoconductor drums Py, Pm, Pc, and Pk are developed into toner images, which are examples of visible images of colors Y, M, C, and K, by developing devices Gy, Gm, Gc, and Gk.

Note that, in the developing devices Gy to Gk, the developers used in a developing operation are supplied by toner cartridges Ky, Km, Kc, and Kk, each of which is an example of a developer container. The toner cartridges Ky, Km, Kc, and Kk are removably mounted in a developer supply device U3*b*.

In first transfer regions Q3*y*, Q3*m*, Q3*c*, and Q3*k*, toner images on the surfaces of the photoconductor drums Py, Pm, Pc, and Pk are sequentially transferred onto an intermediate transfer belt B, which is an example of an intermediate transfer body, in such a manner as to be superposed with one another by first transfer rollers T1*y*, T1*m*, T1*c*, and T1*k*, each of which is an example of a first transfer unit, and a color toner image, which is an example of a polychromatic visible image, is formed on the intermediate transfer belt B. The color toner image formed on the intermediate transfer belt B is transported to a second transfer region Q4.

Note that, in the case where only image information of K color is input from the scanner U1, only the photoconductor drum Pk and the developing device Gk, each of which corresponds to K color, are used, and only a K color toner image is formed.

After executing a first transfer process, residues such as residual developer and paper dust deposited on the surfaces of the photoconductor drums Py, Pm, Pc, and Pk are removed by drum cleaners CLy, CLm, CLc, and CLk, each of which is an example of an image-carrier cleaning unit.

In the present exemplary embodiment, the photoconductor drum Pk, the charging roller CRk, and the drum cleaner CLk are integrated with one another so as to form a K color photoconductor unit UK, which is an example of an image carrier unit. Similarly, the photoconductor drum Py, the charging roller CRy, and the drum cleaner CLy are integrated with one another so as to form a Y color photoconductor unit UY. The photoconductor drum Pm, the charging roller CRm, and the drum cleaner CLm are integrated with one another so as to form an M color photoconductor unit UM. The photoconductor drum Pc, the charging roller CRc, and the drum cleaner CLc are integrated with one another so as to form a C color photoconductor unit UC.

In addition, the K color photoconductor unit UK and the developing device Gk that includes a developing roller ROk, which is an example of a developer carrier, form a K color visible-image forming device UK+Gk. Similarly, the Y color photoconductor unit UY and the developing device Gy that includes the developing roller R0*y* form a Y color visible-image forming device UY+Gy. The M color photoconductor unit UM and the developing device Gm that includes the developing roller R0*m* form an M color visible-image forming device UM+Gm. The C color photoconductor unit UC and the developing device Gc that includes the developing roller ROc form a C color visible-image forming device UC+Gc.

A belt module BM, which is an example of an intermediate transfer device, is disposed below the photoconductor drums Py to Pk. The belt module BM includes the intermediate transfer belt B, a driving roller Rd, which is an example of an intermediate-transfer-body driving unit, a tension roller Rt, which is an example of a tension-applying member, a working roller Rw, which is an example of a member that prevents a belt from moving in a serpentine manner, plural idle rollers Rf, each of which is an example of a driven member, a backup roller T2*a*, which is an example of an opposing member, and the first transfer rollers T1*y*, T1*m*, T1*c*, and T1*k*. The intermediate transfer belt B is supported in such a manner as to be capable of performing a rotational movement in the direction of arrow Ya.

A second transfer unit Ut is disposed below the backup roller T2*a*. The second transfer unit Ut includes a second transfer roller T2*b*, which is an example of a second transfer member. A region in which the second transfer roller T2*b* is brought into contact with the intermediate transfer belt B forms the second transfer region Q4. The backup roller T2*a*, which is an example of an opposing member, is disposed in such a manner as to face the second transfer roller T2*b* with the intermediate transfer belt B interposed therebetween. A contact roller T2*c*, which is an example of a power supplying member, is in contact with the backup roller T2*a*. A second transfer voltage having a polarity that is the same as the charge polarities of toners is applied to the contact roller T2*c*.

The backup roller T2*a*, the second transfer roller T2*b*, and the contact roller T2*c* form a second transfer unit T2.

A media transport path SH2 is disposed below the belt module BM. One of the recording sheets S that has been fed through the media supply path SH1 of the feeder unit U2 is transported to a pair of registration rollers Rr, each of which is an example of a member that adjusts the timing of transportation, by a pair of transport rollers Ra, each of which is an example of a media transport member. The registration rollers Rr transport one of the recording sheets S to a position downstream in a transport direction of the recording sheet S in accordance with the timing at which a toner image that has been formed on the intermediate transfer belt B is transported to the second transfer region Q4. The recording sheet S, which has been sent out by the registration rollers Rr, is guided by a sheet guide SGr, which is disposed on the side on which the registration rollers Rr are disposed, and a pre-transfer sheet guide SG1 and is transported to the second transfer region Q4.

A toner image on the intermediate transfer belt B is transferred onto the recording sheet S by the second transfer unit T2 when the toner image passes through the second transfer region Q4. Note that, in the case of a color toner image, toner images that have been transferred in a first transfer process to a surface of the intermediate transfer belt B in such a manner as to be superposed with one another are collectively transferred in a second transfer process onto the recording sheet S.

The first transfer rollers T1*y* to T1*k*, the second transfer unit T2, and the intermediate transfer belt B form a transfer device T1*y*-to-T1*k*+T2+B according to the present exemplary embodiment.

After executing the second transfer process, the intermediate transfer belt B is cleaned by a belt cleaner CLB, which is disposed downstream from the second transfer region Q4 and which is an example of an intermediate-transfer-body cleaning unit. In the second transfer region Q4, the belt cleaner CLB removes residues such as residual developer and paper dust that remain on the intermediate transfer belt B.

One of the recording sheets S to which a toner image has been transferred is guided by a post-transfer sheet guide SG2 and is sent to a media transport belt BH, which is an example of a transport member. The media transport belt BH transports the recording sheet S to a fixing device F.

The fixing device F includes a heating roller Fh, which is an example of a heating member, and a pressure roller Fp, which is an example of a pressure member. The recording sheet S is transported to a fixing region Q5, which is a region in which the heating roller Fh and the pressure roller Fp are brought into contact with each other. When the recording sheet S passes through the fixing region Q5, the fixing device F applies heat and pressure to the toner image on the recording sheet S, and as a result, the toner image is fixed onto the recording sheet S.

The visible-image forming devices UY+Gy to UK+Gk, the transfer device T1*y*-to-T1*k*+T2+B, and the fixing device F form the image recording unit U3*a* according to the present exemplary embodiment.

A switching gate GT1, which is an example of a switching member, is disposed at a position downstream from the fixing device F. The switching gate GT1 selectively switches between an ejection path SH3, which is disposed on the side on which the media-processing device U4 is disposed, and a reverse path SH4 in such a manner that one of the recording sheets S that has passed through the fixing region Q5 is transported to one of the ejection path SH3 and the reverse path SH4. The recording sheet S that has been transported to the ejection path SH3 is transported to a sheet transport path SH5 of the media-processing device U4. A curl correction member U4*a*, which is an example of a curvature correction member, is disposed on the sheet transport path SH5. The curl correction member U4*a* corrects the curvature of the recording sheet S, or specifically the curl of the recording sheet S that has been transported to the transport path SH5. The recording sheet S whose curl has been corrected is ejected to an ejection tray TH1, which is an example of a media ejection unit, by a pair of ejection rollers Rh, each of which is an example of a media ejection member, in such a manner that a target surface of the recording sheet S onto which an image is to be fixed faces upward. The target surface will hereinafter be referred to as an image fixing surface.

One of the recording sheets S that has been transported by the switching gate GT1 to the side on which the reverse path SH4 of the image forming unit U3 is disposed is transported to the reverse path SH4 of the image forming unit U3 through a second gate GT2, which is an example of a switching member.

In this case, in the case of ejecting the recording sheet S in such a manner that the image fixing surface of the recording sheet S faces downward, after a trailing end of the recording sheet S in the transport direction has passed through the second gate GT2, the transport direction of the recording sheet S is reversed. Here, the second gate GT2 according to the present exemplary embodiment is formed of a thin-film-shaped elastic member. Accordingly, the second gate GT2 allows the recording sheet S, which has been transported to the reverse path SH4, to pass therethrough once, and after the recording sheet S, which has passed through the second gate GT2, has been flipped over, or specifically switched back, the second gate GT2 guides the recording sheet S toward the transport paths SH3 and SH5. The recording sheet S, which has been switched back, passes through the curl correction member U4*a* and is ejected to the ejection tray TH1 in a state where the image fixing surface of the recording sheet S faces downward.

A circulation path SH6 is connected to the reverse path SH4 of the image forming unit U3, and a third gate GT3, which is an example of a switching member, is disposed in a portion in which the reverse path SH4 and the circulation path SH6 are connected to each other. A downstream end of the reverse path SH4 is connected to a reverse path SH7 of the media-processing device U4.

One of the recording sheets S that has been transported to the reverse path SH4 through the switching gate GT1 is transported to the side on which the reverse path SH7 of the media-processing device U4 is disposed by the third gate GT3. Similar to the second gate GT2, the third gate GT3 according to the present exemplary embodiment is formed of a thin-film-shaped elastic member. Accordingly, the third gate GT3 allows the recording sheet S, which has been transported through the reverse path SH4, to pass therethrough once, and after the recording sheet S, which has passed through the third gate GT3, has been switched back, the third gate GT3 guides the recording sheet S toward the circulation path SH6.

The recording sheet S that has been transported to the circulation path SH6 is sent to the second transfer region Q4 again through the media transport path SH2, and a printing operation is performed on a second surface of the recording sheet S, the second surface being opposite to the image fixing surface of the recording sheet S.

The above-described components that are denoted by the reference numerals SH1 to SH7 form a sheet transport path SH. The above-described components that are denoted by the reference numerals SH, Ra, Rr, Rh, SGr, SG1, SG2, BH, and GT1 to GT3 form a sheet transport device SU according to the present exemplary embodiment.

(Description of Developer Supply System)

Figure 3:
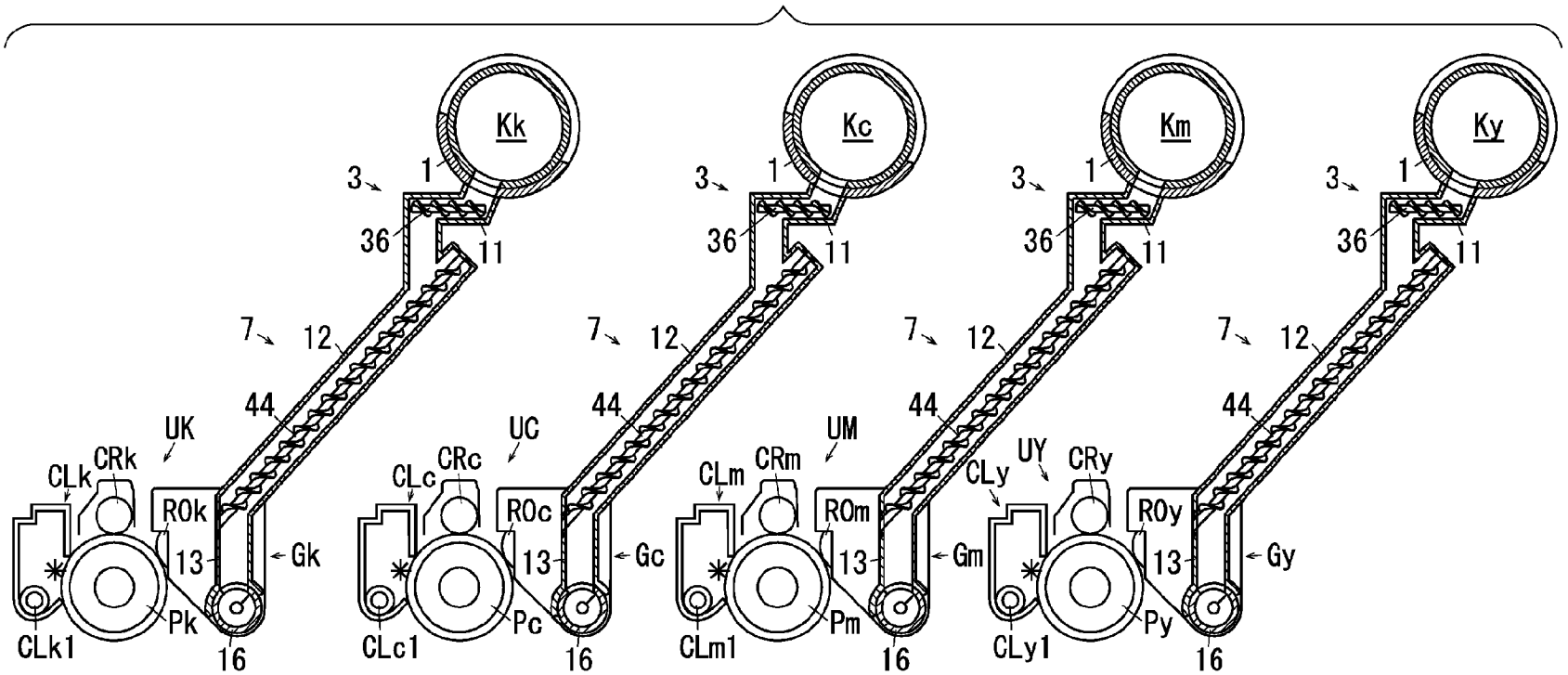
FIG. 3 is a diagram illustrating developer transport devices according to the exemplary embodiment.

FIG. 3 is a diagram illustrating developer transport devices according to the present exemplary embodiment.

Figure 4A:
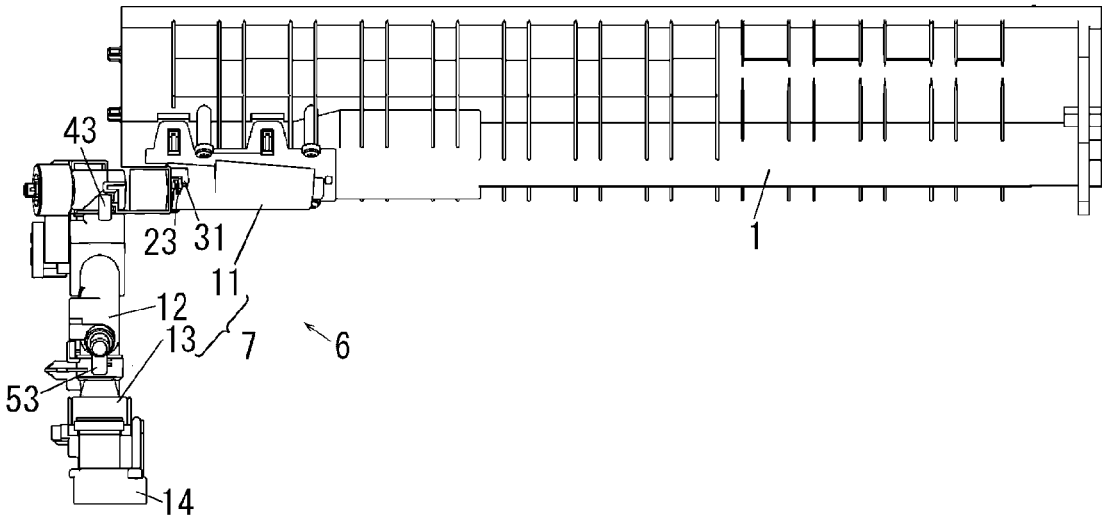
FIGS. 4A and 4B are diagrams each illustrating one of the developer transport devices according to the exemplary embodiment, that is, the developer transport device corresponding to a yellow (Y) developer, FIG. 4A being a side view of the developer transport device and FIG. 4B being a front view of the developer transport device.
Figure 4B:
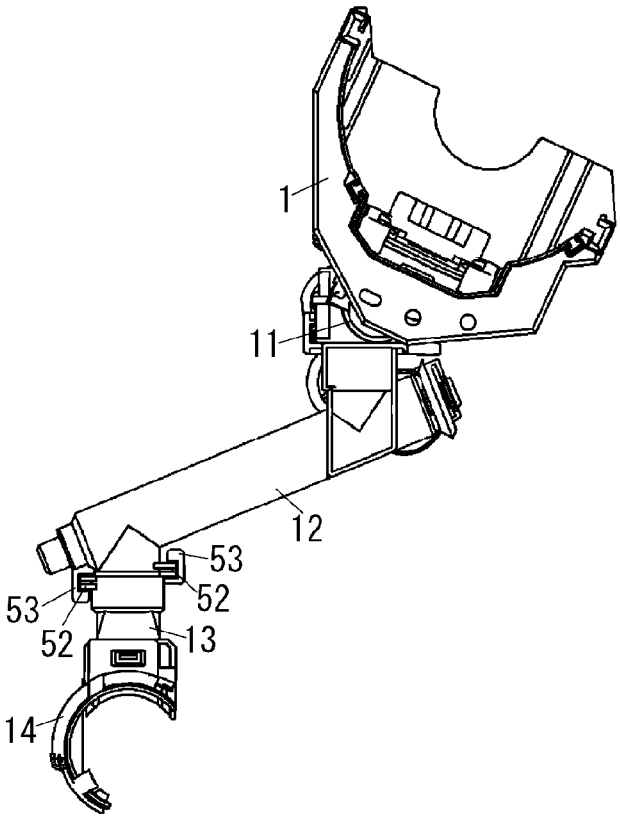

FIGS. 4A and 4B are diagrams each illustrating one of the developer transport devices according to the exemplary embodiment, that is, the developer transport device corresponding to a Y color developer. FIG. 4A is a side view of the developer transport device, and FIG. 4B is a front view of the developer transport device.

In FIG. 3, cartridge holders 1, each of which is an example of a member for mounting and unmounting a container, are supported on an upper portion of the image forming unit U3. Each of the cartridge holders 1 is provided so as to correspond to one of the toner cartridges Ky to Kk, which respectively correspond to the colors Y, M, C, and K. The toner cartridges Ky to Kk are removably supported by the corresponding cartridge holders 1.

In FIG. 3 to FIG. 4B, dispensers 6, each of which is an example of a developer transport device, are supported on rear portions of the corresponding cartridge holders 1. Each of the dispensers 6 includes a transport path 7, which is an example of a cylinder member. The transport path 7 includes a horizontal transport unit 11 that is connected to a bottom surface of the rear portion of the cartridge holder 1. The horizontal transport unit 11 extends backward. An inclined transport unit 12 extending obliquely downward to the left side is connected to a rear end of the horizontal transport unit 11. A drop transport unit 13 extending downward is connected to a lower end of the inclined transport unit 12. A semicylindrical connecting portion 14 is attached to a lower end of the drop transport unit 13. Each of the connecting portions 14 is connected to a cylindrical supply portion 16 of a corresponding one of the developing devices Gy to Gk. The above-mentioned transport units 11 to 13 form one of the transport paths 7 according to the present exemplary embodiment.

Figure 5A:
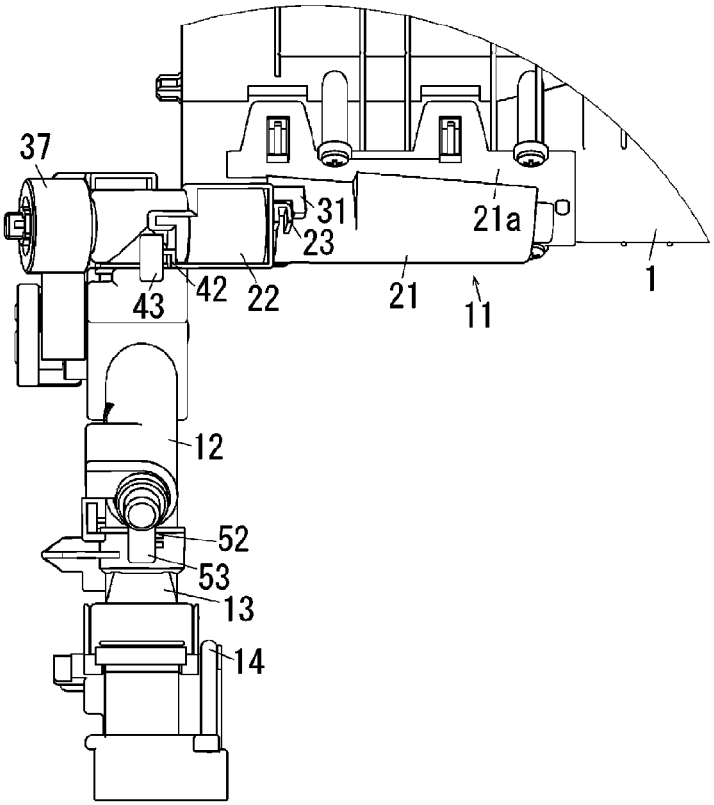
FIGS. 5A and 5B are diagrams each illustrating connection structures of transport units according to the exemplary embodiment, FIG. 5A being an enlarged view of the transport units and FIG. 5B being a diagram illustrating a state where connecting portions are disconnected from the state illustrated in FIG. 5A.
Figure 5B:
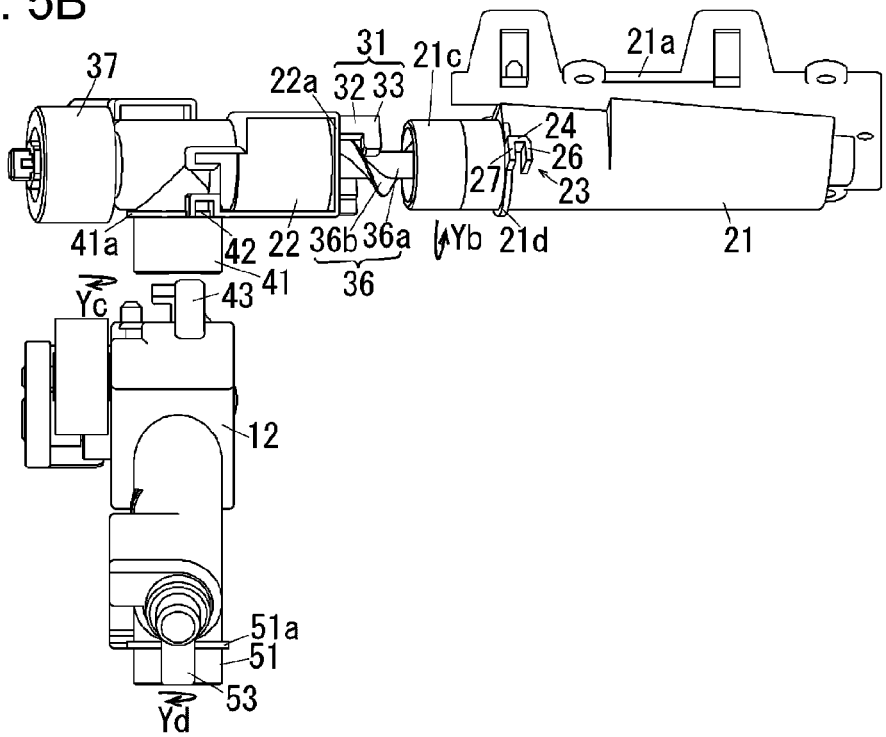

FIGS. 5A and 5B are diagrams each illustrating connection structures of the transport units according to the present exemplary embodiment. FIG. 5A is an enlarged view of the transport units, and FIG. 5B is a diagram illustrating a state where connecting portions are disconnected from the state illustrated in FIG. 5A.

Figure 6A:
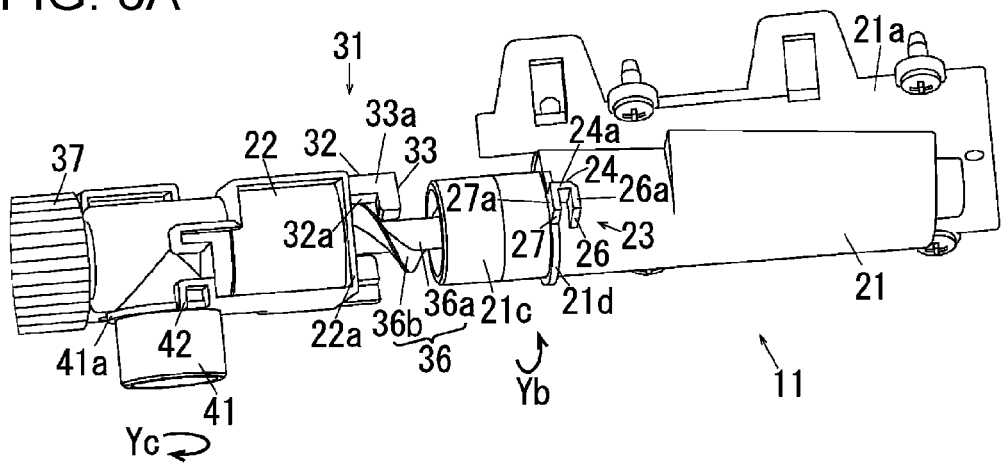
FIGS. 6A and 6B are diagrams each illustrating a state where connection in a horizontal transport unit is disconnected, FIG. 6A being a view taken of the right side of the horizontal transport unit and FIG. 6B being a view taken of the left side of the horizontal transport unit.
Figure 6B:
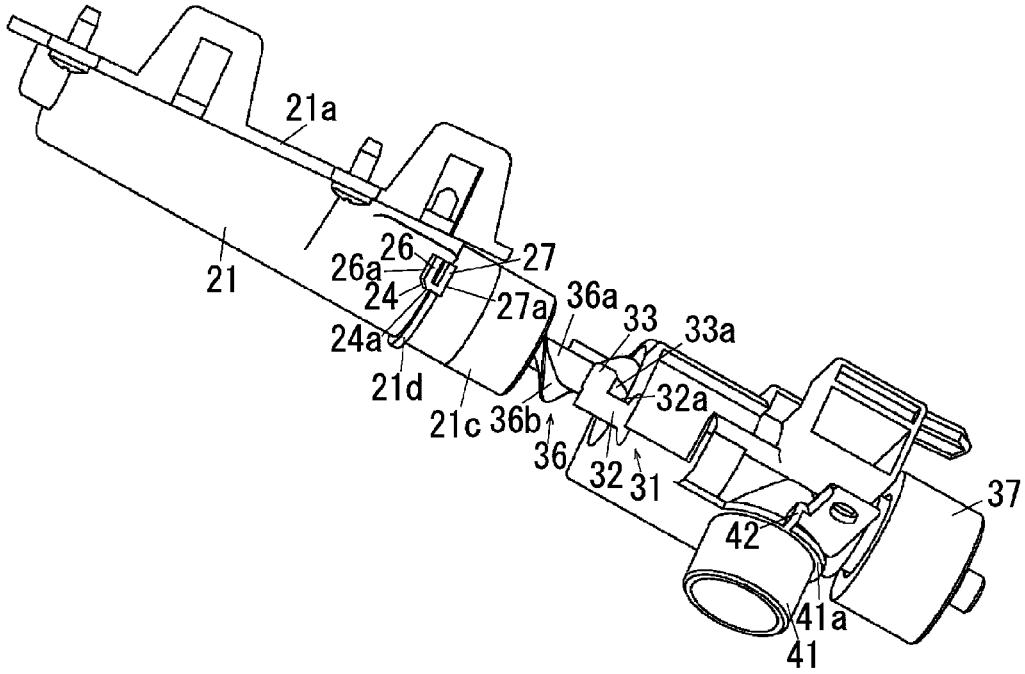

FIGS. 6A and 6B are diagrams each illustrating a state where connection in the horizontal transport unit is disconnected. FIG. 6A is a view taken of the right side of the horizontal transport unit, and FIG. 6B is a view taken of the left side of the horizontal transport unit.

Figure 7A:
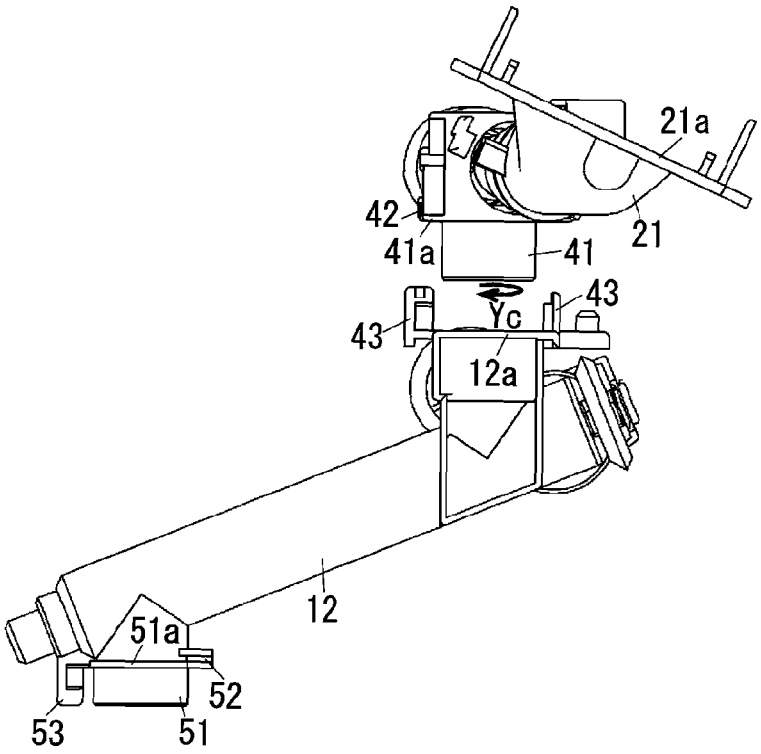
FIGS. 7A and 7B are diagrams each illustrating a state where the horizontal transport unit and an inclined transport unit are disconnected, FIG. 7A being a view taken of the front side of the horizontal transport unit and the inclined transport unit and FIG. 7B being a view taken of the left side of the horizontal transport unit and the inclined transport unit.
Figure 7B:
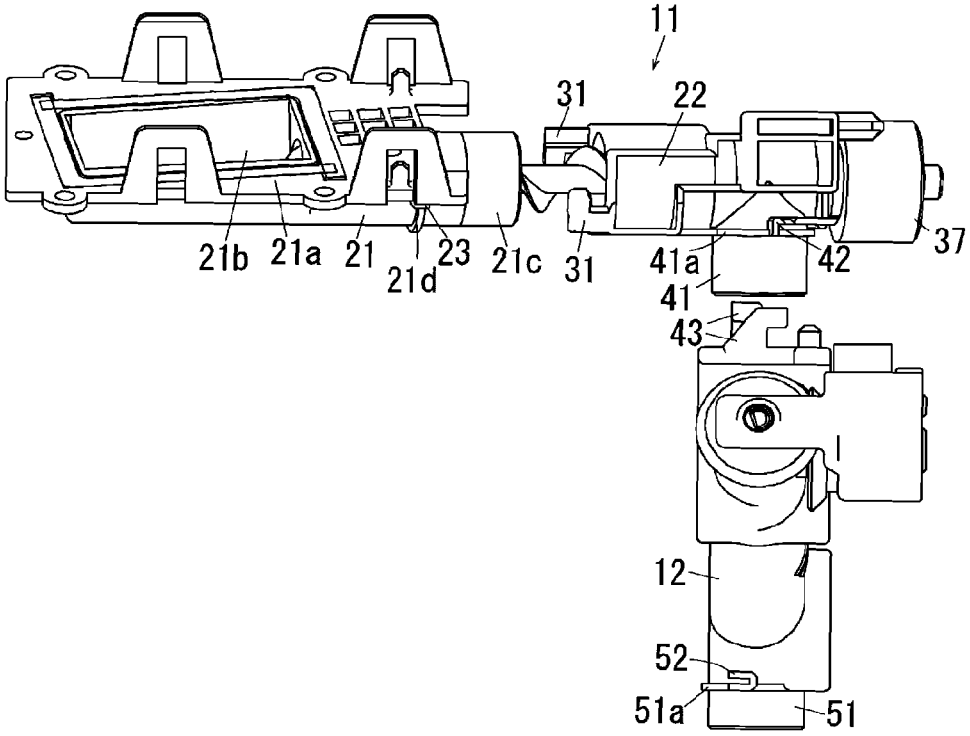

FIGS. 7A and 7B are diagrams each illustrating a state where the horizontal transport unit and the inclined transport unit are disconnected. FIG. 7A is a view taken of the front side of the horizontal transport unit and the inclined transport unit, and FIG. 7B is a view taken of the left side of the horizontal transport unit and the inclined transport unit.

Note that since the dispensers 6 have the same configuration, one of the dispensers 6 will be described below as a representative example.

In FIG. 4A to FIG. 7B, the horizontal transport unit 11 includes a horizontal upstream cylinder 21, which is an example of a first cylinder member, and a horizontal downstream cylinder 22, which is an example of a second cylinder member. The horizontal upstream cylinder 21 and the horizontal downstream cylinder 22 are each formed in a cylindrical shape whose interior is hollow. In other words, the interior space of the horizontal upstream cylinder 21 and the interior space of the horizontal downstream cylinder 22 form part of a transport path of the corresponding developer. A plate-shaped inflow portion 21*a* is formed in a front end portion of the horizontal upstream cylinder 21. In FIG. 7B, an inlet port 21*b* is formed in a center portion of the inflow portion 21*a*. Each of the developers from the toner cartridges Ky to Kk enters the corresponding inlet port 21*b*. In FIG. 5A to FIG. 7B, an inserting portion 21*c* having a cylindrical shape is formed in a rear end portion of the horizontal upstream cylinder 21. The inserting portion 21*c* is inserted into a front end portion of the horizontal downstream cylinder 22.

A ring-shaped flange portion 21*d*, which is an example of a to-be-abutted portion, is formed at a position corresponding to a front end of the inserting portion 21*c*. The flange portion 21*d* is in the form of a doughnut-shaped plate projecting outward in a radial direction thereof.

A pair of horizontal connecting protrusions 23, each of which is an example of a to-be-fastened member, are formed on the flange portion 21*d*. The pair of horizontal connecting protrusions 23 are formed in such a manner as to protrude outward in the radial direction from an outer peripheral surface of the horizontal upstream cylinder 21. The pair of horizontal connecting protrusions 23 are disposed on the left and right sides as illustrated in FIG. 6A and FIG. 6B. The pair of horizontal connecting protrusions 23 each include a downstream wall 24 that is positioned at a downstream end of the horizontal connecting protrusion 23 in a fastening direction Yb illustrated in FIG. 6A. Each of the downstream walls 24 according to the present exemplary embodiment is in the form of a wall extending in the front-rear direction. Each of the downstream walls 24 has a downstream surface 24*a* formed at a downstream end thereof in the fastening direction Yb, the downstream surface 24*a* being an example of a first surface. In addition, each of the downstream walls 24 has a front wall 26 and a rear wall 27 respectively formed at the front and rear ends thereof. The front wall 26 and the rear wall 27 are formed in such a manner that a downstream end of the front wall 26 and a downstream end of the rear wall 27 in the fastening direction Yb are continuous with the left and right ends of the downstream wall 24. The front walls 26 and the rear walls 7 according to the present exemplary embodiment are each in the form of a wall extending toward the upstream side in the fastening direction Yb. Accordingly, the pair of horizontal connecting protrusions 23 are each formed so as to have a substantially U shape when viewed from a side. A front surface 26*a*, which is an example of a second surface, is formed on the outside of each of the front walls 26, and a rear surface 27*a*, which is an example of a second surface, is formed on the outside of each of the rear walls 27.

An abutting portion 22*a* is formed at a front end of the horizontal downstream cylinder 22 in such a manner as to correspond to the flange portion 21*d*. A front surface of the abutting portion 22*a* is formed so as to be capable of being brought into contact with a rear surface of the flange portion 21*d* and with the rear surface 27*a* of the corresponding rear wall 27. Thus, the front surface of the abutting portion 22*a* also has a function of serving as a second fastening surface.

A pair of horizontal connecting hooks 31, each of which is an example of a fastening member, are formed on the abutting portion 22*a*. In the horizontal downstream cylinder 22, the pair of horizontal connecting hooks 31 are located at positions corresponding to the pair of horizontal connecting protrusions 23. Consequently, the pair of horizontal connecting hooks 31 are disposed on the left and right sides so as to correspond to the pair of horizontal connecting protrusions 23. Each of the pair of horizontal connecting hooks 31 includes an arm portion 32, which is an example of an arm portion. Each of the arm portions 32 extends in a forward direction, which is a direction crossing the fastening direction Yb. Each of the arm portions 32 has a downstream contact surface 32*a* formed on the upstream side in the fastening direction Yb, the downstream contact surface 32*a* being an example of a first fastening surface. In the present exemplary embodiment, the length of each of the arm portions 32 is set in such a manner that the length of each of the downstream contact surfaces 32*a* corresponds to the gap between the corresponding front surface 26*a* and the corresponding rear surface 27*a*.

A hook portion 33 is formed at a front end of each of the arm portions 32. The hook portions 33 according to the present exemplary embodiment extend toward the upstream side in the fastening direction Yb. A front contact surface 33*a*, which is an example of a second fastening surface, is formed in a rear surface of each of the hook portions 33. Note that, as illustrated in FIG. 5A, the length of each of the hook portions 33 according to the present exemplary embodiment in the fastening direction Yb is set to be smaller than the length of the corresponding front wall 26 in the fastening direction Yb.

Thus, in FIG. 5A and FIG. 6A, in a state where the inserting portion 21*c* of the horizontal upstream cylinder 21 is received in the horizontal downstream cylinder 22, when the horizontal upstream cylinder 21 and the horizontal downstream cylinder 22 are rotated relative to each other in such a manner that the horizontal upstream cylinder 21 moves in the fastening direction Yb with respect to the horizontal downstream cylinder 22, the pair of horizontal connecting protrusions 23 are fastened to the pair of horizontal connecting hooks 31, and the horizontal upstream cylinder 21 and the horizontal downstream cylinder 22 are connected to each other. In this case, regarding the pair of horizontal connecting protrusions 23 and the pair of horizontal connecting hooks 31, the downstream surfaces 24*a* are in contact with the corresponding downstream contact surfaces 32*a*, and the front surfaces 26*a* are in contact with the corresponding front contact surfaces 33*a*. In addition, the rear surfaces 27*a* are in contact with the front surface of the corresponding abutting portion 22*a*.

Note that, as illustrated in FIG. 6A, a horizontal auger 36, which is an example of a transport member, is accommodated in the horizontal transport unit 11. Each of the horizontal augers 36 according to the present exemplary embodiment includes a rotary shaft 36*a* and a helical transport blade 36*b* that is supported on the outer periphery of the rotary shaft 36*a*. A rear end portion of the horizontal auger 36 extends through the horizontal transport unit 11, and a gear 37 is supported at the rear end of the horizontal auger 36. The gear 37 is formed so as to be capable of receiving a driving force that is transmitted from a driving source (not illustrated). Thus, when a driving force is transmitted to the gear 37, the horizontal auger 36 rotates, and the developer in the horizontal transport unit 11 is transported.

In FIG. 5A to FIG. 7B, an inclined connecting portion 41 is formed on a rear lower portion of the horizontal downstream cylinder 22. Similar to the inserting portion 21*c*, the inclined connecting portion 41 is formed in a cylindrical shape. Note that each of the horizontal downstream cylinders 22 according to the present exemplary embodiment has a function of serving as a second cylinder member for the corresponding horizontal upstream cylinder 21 and also has a function of serving as a first cylinder member for the corresponding inclined transport unit 12, which is an example of a second cylinder member. In FIGS. 7A and 7B, a fastening direction Yc in which the horizontal downstream cylinders 22 and the corresponding inclined transport units 12 are fastened to each other is set to be the circumferential direction of the inclined connecting portions 41. Thus, in the present exemplary embodiment, the fastening direction Yc, in which the horizontal downstream cylinders 22 and the corresponding inclined transport units 12 are fastened to each other, is different from the fastening direction Yb, in which the horizontal downstream cylinder 22 and the horizontal upstream cylinder 21 are fastened to each other.

A flange portion 41*a*, which is an example of a to-be-abutted portion, is formed in an upper end portion of the inclined connecting portion 41. A pair of inclined connecting protrusions 42, each of which is an example of a to-be-fastened member, are formed on the flange portion 41*a*. In the fastening direction Yc, in which the horizontal downstream cylinder 22 and the inclined transport unit 12 are fastened to each other, the flange portion 41*a* is formed in a similar manner to the flange portion 21*d*, and the pair of inclined connecting protrusions 42 are formed in a similar manner to the pair of horizontal connecting protrusions 23.

In FIG. 5A, FIG. 5B, FIG. 7A, and FIG. 7B, an abutting portion 12*a* and a pair of inclined connecting hooks 43 are formed at an upper end of the inclined transport unit 12. The abutting portion 12*a* is formed in a similar manner to the abutting portion 22*a*, and the pair of inclined connecting hooks 43, each of which is an example of a fastening member, are formed in a similar manner to the pair of horizontal connecting hooks 31.

Note that the pair of inclined connecting protrusions 42 have a configuration similar to that of the pair of horizontal connecting protrusions 23, each of which includes the downstream wall 24, the front wall 26, and the rear wall 27, and the pair of inclined connecting hooks 43 have a configuration similar to that of the pair of horizontal connecting hooks 31, each of which includes the arm portion 32 and the hook portion 33. Descriptions of the pair of inclined connecting protrusions 42 and the pair of inclined connecting hooks 43 will be omitted to avoid repeated descriptions.

Note that the inclined transport unit 12 is formed in a hollow cylindrical shape, and a developer transport path is formed in the inclined transport unit 12. Similar to the horizontal auger 36, an inclined auger 44, which is an example of a transport member, is disposed in the developer transport path, and description of the inclined auger 44 will be omitted to avoid repeated description.

Figure 8A:
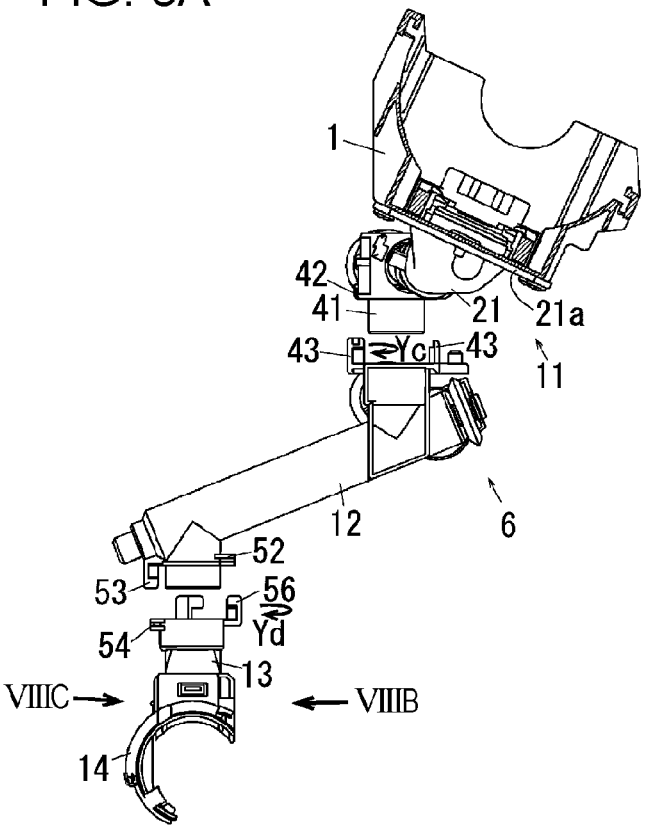
FIGS. 8A to 8D are diagrams each illustrating a state where the connection structures of the transport units according to the exemplary embodiment are disconnected, FIG. 8A being a view taken of the front side of the transport units, FIG. 8B illustrating the transport units when viewed from the direction of arrow VIIIB in FIG. 8A, FIG. 8C illustrating the transport units when viewed from the direction of arrow VIIIC in FIG. 8A, and FIG. 8D illustrating the transport units when viewed from the direction of arrow VIIID in FIG. 8B.
Figure 8B:
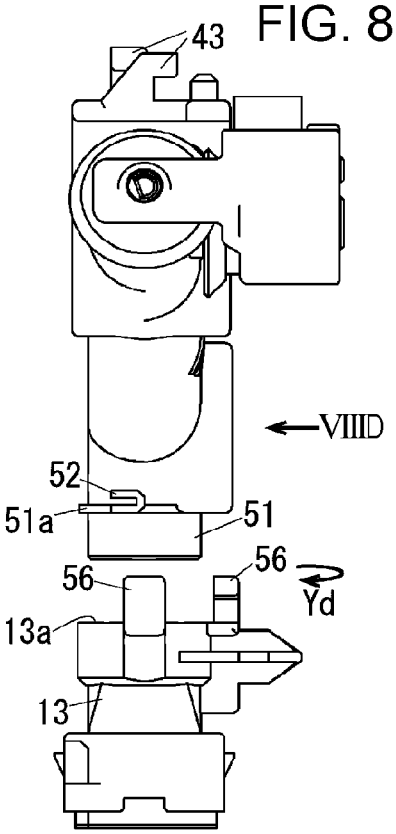
Figure 8C:
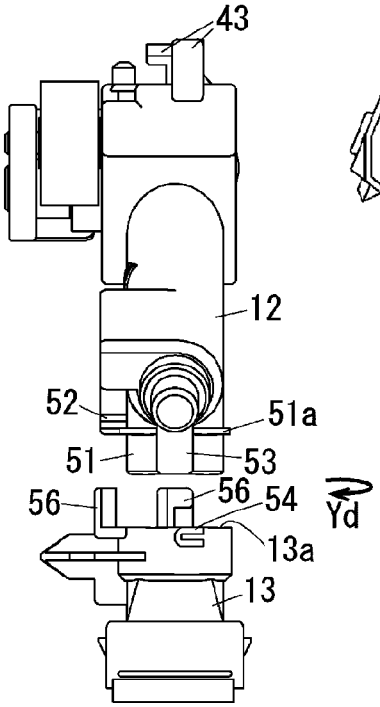
Figure 8D:
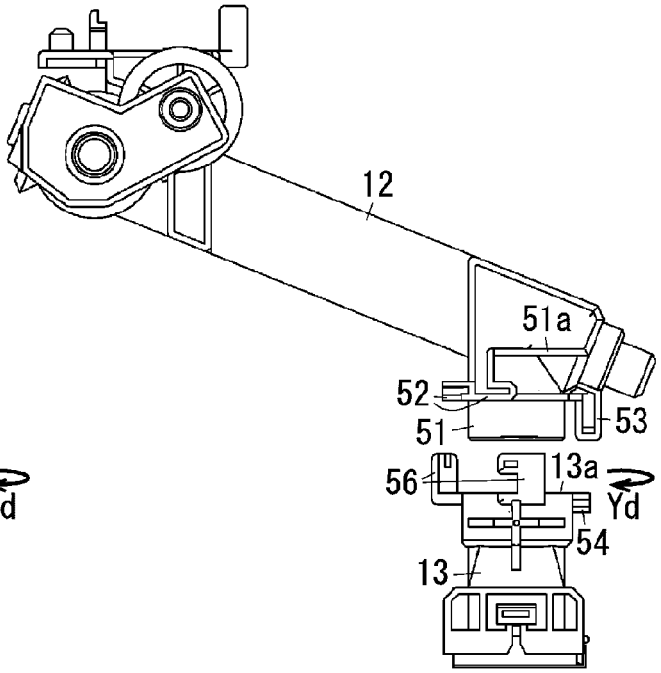

FIGS. 8A to 8D are diagrams each illustrating a state where the connection structures of the transport units according to the present exemplary embodiment are disconnected. FIG. 8B illustrates the transport units when viewed from the direction of arrow VIIIB in FIG. 8A. FIG. 8C illustrates the transport units when viewed from the direction of arrow VIIIC in FIG. 8A. FIG. 8D illustrates the transport units when viewed from the direction of arrow VIIID in FIG. 8B.

In FIG. 5A, FIG. 5B, FIG. 7A, FIG. 7B, and FIGS. 8A to 8D, a drop connecting portion 51 is formed on a lower end portion of the inclined transport unit 12. Similar to the inserting portion 21*c* and the inclined connecting portion 41, the drop connecting portion 51 is formed in a cylindrical shape. Each of the inclined connecting portions 41 according to the present exemplary embodiment has a function of serving as a second cylinder member for the corresponding horizontal downstream cylinder 22 and also has a function of serving as a first cylinder member for the corresponding drop transport unit 13, which is an example of a second cylinder member. In FIGS. 8A to 8D, a fastening direction Yd in which the drop transport unit 13 and the inclined transport unit 12 are fastened to each other is set to be the circumferential direction of the drop connecting portion 51.

A flange portion 51*a*, which is an example of a to-be-abutted portion, is formed in an upper end portion of the drop connecting portion 51. Drop connecting protrusions 52, each of which is an example of a to-be-fastened member, and a drop connecting hook 53, which is an example of a fastening member, are formed on the flange portion 51*a*. In the present exemplary embodiment, the drop connecting protrusions 52 are positioned on the right side and the rear side of the flange portion 51*a*, and the drop connecting hook 53 is positioned on the left side of the flange portion 51*a*.

In FIG. 5A, FIG. 5B, and FIGS. 8A to 8D, an abutting portion 13*a*, a drop connecting protrusion 54, which is an example of a to-be-fastened member, and drop connecting hooks 56, each of which is an example of a fastening member, are formed at an upper end of the drop transport unit 13. In the present exemplary embodiment, the drop connecting hooks 56 are positioned on the right side and the rear side so as to correspond to the drop connecting protrusions 52, which are located above the drop connecting hooks 56, and the drop connecting protrusion 54 is positioned on the left side so as to correspond to the drop connecting hook 53, which is located above the drop connecting protrusion 54.

In the fastening direction Yd, in which the drop transport unit 13 and the inclined transport unit 12 are fastened to each other, the drop connecting protrusions 52 and 54 are formed in a similar manner to the pair of horizontal connecting protrusions 23, and the drop connecting hooks 53 and 56 are formed in a similar manner to the pair of horizontal connecting hooks 31.

Note that the drop connecting protrusions 52 and 54 each have a configuration similar to that of the pair of horizontal connecting protrusions 23, each of which includes the downstream wall 24, the front wall 26, and the rear wall 27, and the drop connecting hooks 53 and 56 each have a configuration similar to that of the pair of horizontal connecting hooks 31, each of which includes the arm portion 32 and the hook portion 33. Descriptions of the drop connecting protrusions 52 and 54 and the drop connecting hooks 53 and 56 will be omitted to avoid repeated descriptions.

Note that the drop transport unit 13 is formed in a hollow cylindrical shape, and a developer transport path is formed in the drop transport unit 13. A transport member is not disposed in the transport path in the drop transport unit 13, and in the transport path, the developer is to be transported as a result of falling due to gravity.

The above-described components that are denoted by the reference numerals 11 to 53 form the dispenser 6 that is an example of a developer transport device according to the present exemplary embodiment.

(Function of Developer Transport Device)

In the copying machine U according to the present exemplary embodiment, which has the above-described configuration, once a job has been started, the horizontal augers 36 and the like are driven in accordance with the amounts of the developers used in the developing devices Gy to Gk. Accordingly, the developers in the toner cartridges Ky to Kk are transported to the corresponding developing devices Gy to Gk via the corresponding transport units 11 to 13.

In the present exemplary embodiment, the transport units 11 to 13 are formed of plural hollow pipe-shaped members connected to one another.

Figure 9A:
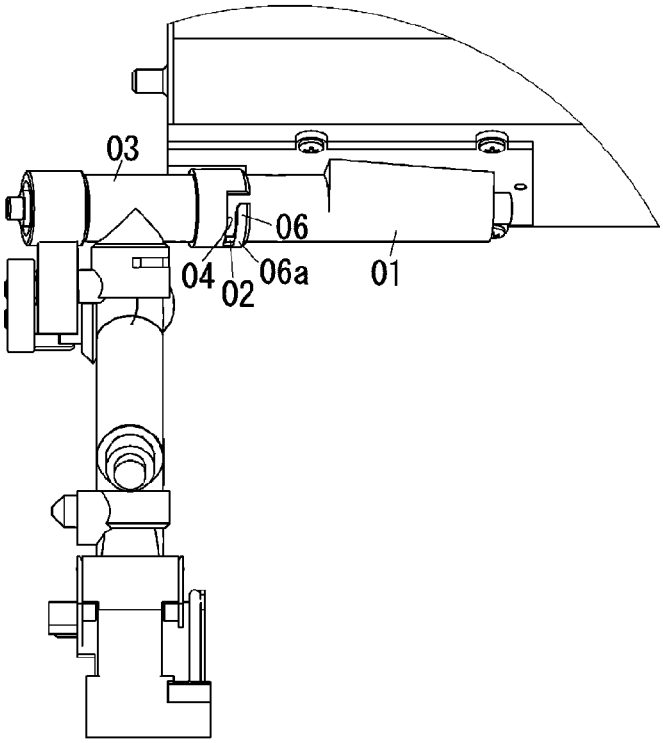
FIG. 9A RELATED ART
FIGS. 9A and 9B are diagrams each illustrating a connection structure of members that are included in a developer transport path of the related art, FIG. 9A being a diagram illustrating a state where the members are connected to each other and FIG. 9B being a diagram illustrating a state where the members are disconnected from each other.
Figure 9B:
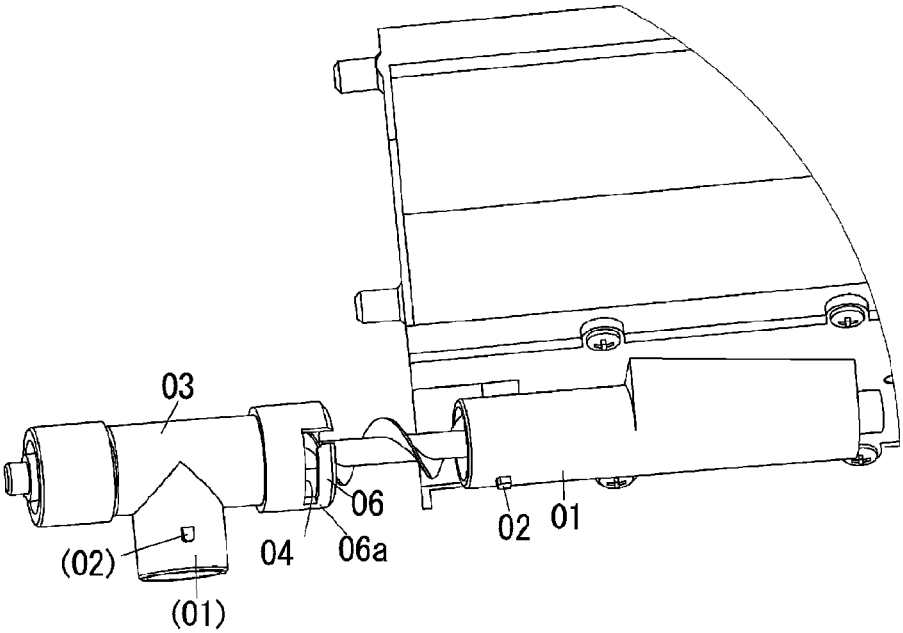
FIG. 9B RELATED ART

FIGS. 9A and 9B are diagrams each illustrating a connection structure of members that are included in a developer transport path of the related art. FIG. 9A is a diagram illustrating a state where the members are connected to each other, and FIG. 9B is a diagram illustrating a state where the members are disconnected from each other.

In the related art, a transport unit has been formed by fabricating plural members, which are portions of the transport unit, and then connecting the plural members to one another due to the curved shape of a developer transport path, a limitation on manufacturing the transport unit, such as die cutting, and the like. In the configuration of the related art illustrated in FIGS. 9A and 9B, a protrusion 02, which is in the form of a rectangular column, is formed on an upstream cylinder member 01, and an L-shaped slit 04 having a width that allows the protrusion 02 to pass therethrough is formed in a downstream cylinder member 03. Accordingly, by rotating the cylinder members 01 and 03 in the circumferential direction of the cylinder members 01 and 03 after connecting the cylinder members 01 and 03 to each other in the axial direction of the cylinder members 01 and 03, the protrusion 02 is moved to the deepest position in the slit 04, and as a result, the cylinder members 01 and 03 are fastened to each other.

Here, there is a case where loads act on the developer transport paths as a result of external forces acting when mounting or unmounting the toner cartridges Ky to Kk, the developing devices Gy to Gk, and the like. However, in the configuration illustrated in FIGS. 9A and 9B, in the case where an external force acts in one of directions other than the direction in which the upstream cylinder member 01 and the downstream cylinder member 03 become unfastened from each other, examples of the directions including a direction in which shafts of the cylinder members 01 and 03 are deformed with respect to the axial direction of the cylinder members 01 and 03 and a direction in which the cylinder members 01 and 03 are fastened to each other, stress is likely to concentrate at a portion in which the protrusion 02 and the slit 04 are in contact with each other because the protrusion 02 is sufficiently small with respect to the slit 04. Therefore, there is a probability that cracks will be generated in a portion of the slit 04 at which the stress has concentrated, and in the worst case, there is a probability that a base end portion 06*a* of a portion 06 that is formed in a cantilever manner will break and that the upstream cylinder member 01 and the downstream cylinder member 03 will become unfastened from each other. When the upstream cylinder member 01 and the downstream cylinder member 03 become unfastened from each other, there is a problem in that the developer in the transport path will leak out.

(Modifications)

Although the exemplary embodiment of the present invention has been described in detail above, the present invention is not limited to the above-described exemplary embodiment, and various changes may be made within the scope of the present invention as described in the claims. Exemplary modifications (H01 to H05) of the present invention will be described below.

(H01) Although a copying machine has been described in the above-described exemplary embodiment as an example of an image forming apparatus, the image forming apparatus is not limited to such a copying machine and may be formed of, for example, a printer, a facsimile machine, a multifunction machine that has some or all of the functions of the printer and the facsimile machine, or the like.

(H02) Although in the above-described exemplary embodiment, the configuration of the copying machine U in which developers of the four colors are to be used has been described as an example, the present invention is not limited to this configuration and may also be applied to, for example, an image forming apparatus that uses a monochromatic color developer or developers of three or less colors or 5 or more colors.

(H03) Although in the above-described exemplary embodiment, the configuration in which the transport units 11 to 13 are formed by connecting four pipe-shaped members to one another has been described as an example, the present invention is not limited to this configuration, and a configuration in which 5 or more or three or less members are connected to one another may be employed.

(H04) Although in the above-described exemplary embodiment, the configuration in which the protrusions 23, 42, 52, and 54 are located on the upstream side, and the hooks 31, 43, 53, and 56 are located on the downstream side in the transport direction of the developer has been described as an example, the present invention is not limited to this configuration. A configuration in which the protrusions are located on the downstream side and in which the hooks are located on the upstream side may be employed. For example, the end portions of the inclined transport unit 12 may be protrusions, and the horizontal downstream cylinder 22 and the drop transport unit 13 may be hooks. In addition, although the configuration in which the pair of horizontal connecting protrusions 23 are formed on the horizontal upstream cylinder 21 and in which the pair of horizontal connecting hooks 31 are formed on the horizontal downstream cylinder 22 has been described as an example, for example, a protrusion and a hook may be formed on the horizontal upstream cylinder 21, and a hook and a protrusion may be formed on the horizontal downstream cylinder 22 in such a manner that the protrusions and the hooks are positioned in a staggered arrangement. Furthermore, although the configuration in which the protrusions 23, 42, 52, and 54 and the hooks 31, 43, 53, and 56 are provided in pairs has been described as an example, the number of each of the protrusions and the number of each of the hooks may be one or three or more.

(H05) Although in the above-described exemplary embodiment, it is desirable that the front wall 26 be formed in such a manner that the length of the front wall 26 is larger than the length the hook portion 33, the length of the front wall 26 may be the same as or smaller than the length of the hook portion 33.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer transport device comprising:

a cylinder member in which a transport path, through which a developer is to be transported, is formed, the cylinder member including a first cylinder member in which an upstream portion of the transport path is formed and a second cylinder member that is connected to the first cylinder member and in which a downstream portion of the transport path is formed;

a transport member that is disposed in the transport path and that transports the developer by rotating;

a to-be-fastened member that is formed on one of the first cylinder member and the second cylinder member, the to-be-fastened member having a first surface formed in a downstream end portion of the to-be-fastened member in a fastening direction in which the second cylinder member is fastened to the first cylinder member and a second surface formed in such a manner as to extend in the fastening direction; and a fastening member that is formed on another one of the first cylinder member and the second cylinder member and that is to be fastened to the to-be-fastened member, the fastening member having a first fastening surface and a second fastening surface that respectively face the first surface and the second surface when the fastening member is fastened to the to-be-fastened member.

2. The developer transport device according to claim 1, wherein the to-be-fastened member has a substantially protruding shape and has the first surface extending in a direction crossing the fastening direction and the second surface extending in the fastening direction from an end of the first surface in the direction crossing the fastening direction, and wherein the fastening member includes an arm portion that extends in the direction crossing the fastening direction and that has a surface in which the first fastening surface is formed and a hook portion that extends in the fastening direction from an end of the arm portion and that has a surface in which the second fastening surface is formed.

3. The developer transport device according to claim 2, wherein the second surface is formed in such a manner as to be longer than the second fastening surface in the fastening direction.

4. An image forming apparatus comprising:

an image carrier;

a latent image forming device that forms a latent image on the image carrier;

a developing device that develops the latent image on the image carrier into a visible image;

the developer transport device according to claim 1 that transports a replenishing developer to the developing device;

a transfer device that transfers the visible image on the image carrier onto a medium; and a fixing device that fixes the visible image on the medium onto the medium.

5. An image forming apparatus comprising:

an image carrier;

a latent image forming device that forms a latent image on the image carrier;

a developing device that develops the latent image on the image carrier into a visible image;

the developer transport device according to claim 2 that transports a replenishing developer to the developing device;

a transfer device that transfers the visible image on the image carrier onto a medium; and a fixing device that fixes the visible image on the medium onto the medium.

6. An image forming apparatus comprising:

an image carrier;

a latent image forming device that forms a latent image on the image carrier;

a developing device that develops the latent image on the image carrier into a visible image;

the developer transport device according to claim 3 that transports a replenishing developer to the developing device;

a transfer device that transfers the visible image on the image carrier onto a medium; and a fixing device that fixes the visible image on the medium onto the medium.

* * * * *